US005839878A

United States Patent [19]

Maier

[11] Patent Number: 5,839,878

[45] Date of Patent: Nov. 24, 1998

[54] GAS TURBINE STATOR VANE

[75] Inventor: Mark Stefan Maier, Palm City, Fla.

[73] Assignee: United Technologies Corporation, Hartford, Conn.

[21] Appl. No.: 724,532

[22] Filed: Sep. 30, 1996

[51] Int. Cl.[6] ..... F01D 1/02

[52] U.S. Cl. ..... 415/209.2; 415/209.3; 415/191

[58] Field of Search ..... 415/209.1, 209.2, 415/209.3, 209.4, 189, 190, 191

[56] References Cited

U.S. PATENT DOCUMENTS

| | | | |
|---|---|---|---|
| 3,070,353 | 12/1962 | Welsh | 415/209.1 |
| 3,938,906 | 2/1976 | Michel et al. | 415/209.3 |
| 4,477,086 | 10/1984 | Feder et al. | 277/26 |
| 5,074,752 | 12/1991 | Murphy et al. | 415/209.4 |
| 5,129,783 | 7/1992 | Hayton | 415/209.3 |
| 5,487,642 | 1/1996 | Norton et al. | 415/209.2 |
| 5,653,580 | 8/1997 | Faulder et al. | 415/209.3 |

FOREIGN PATENT DOCUMENTS

| | | | |
|---|---|---|---|
| 36-6485 | 8/1961 | Canada | 415/209.2 |
| 946545 | 8/1956 | Germany | 415/209.2 |

*Primary Examiner*—Thomas E. Denion
*Attorney, Agent, or Firm*—Richard D. Getz

[57] ABSTRACT

A stator vane assembly is provided having a plurality of stator vane segments and support rings. Each stator vane segment includes an inner platform, an outer platform, an airfoil extending between the inner and outer platforms, and a first sealing flange. The first sealing flange extends out from one of the inner or outer platforms, and includes an arcuate seal surface. The stator vane segment may pivot about the arcuate seal surface to accommodate movement of the stator vane segment.

6 Claims, 2 Drawing Sheets

FIG.2
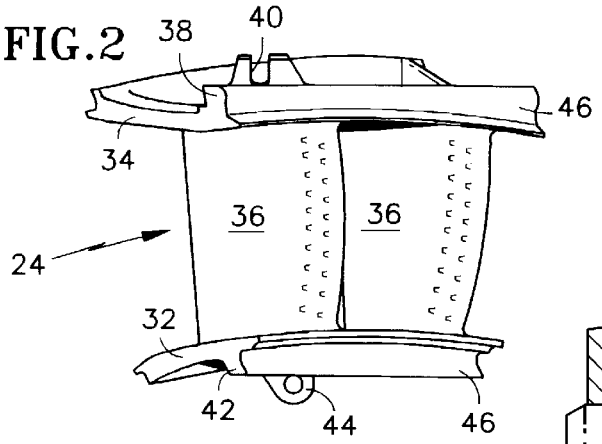
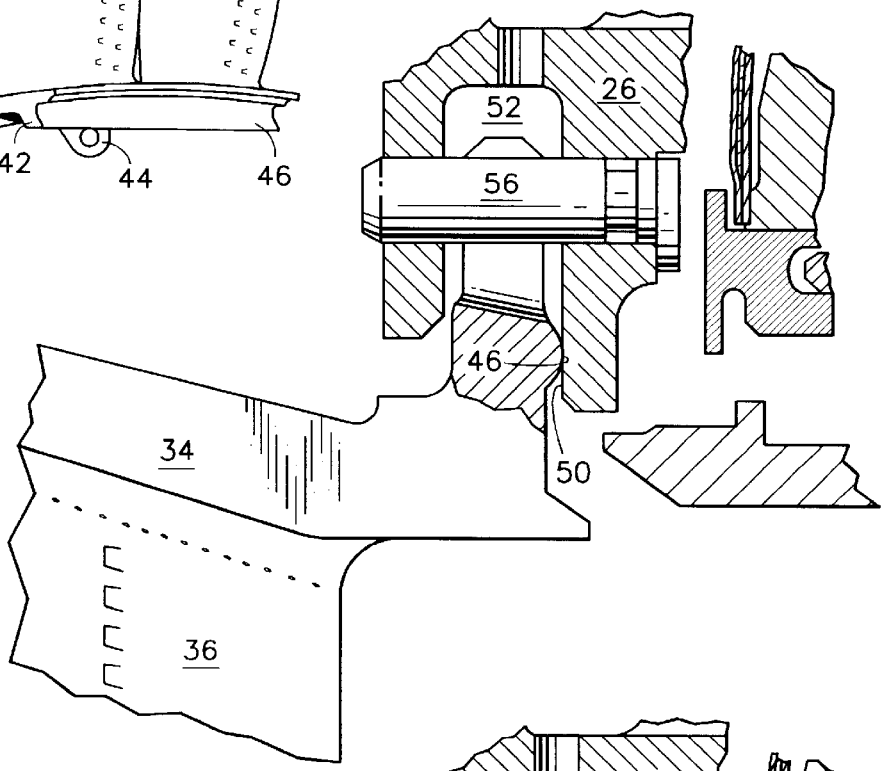
FIG.3
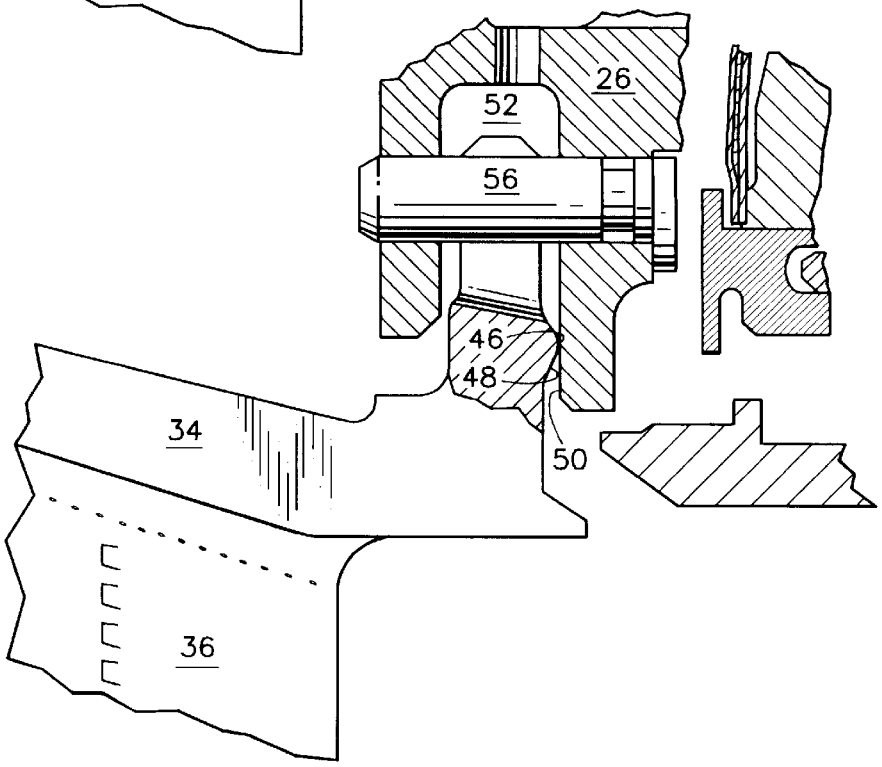
FIG.4

GAS TURBINE STATOR VANE

The invention was made under a U.S. Government contract and the Government has rights herein.

BACKGROUND OF THE INVENTION

1. Technical Field

This invention relates to gas turbine engines in general, and to stator vanes within gas turbine engines in particular.

2. Background Information

Gas turbine stator vane assemblies typically include a plurality of vane segments which collectively form the annular vane assembly. Each vane segment includes one or more airfoils extending between an outer platform and an inner platform. The inner and outer platforms collectively provide radial boundaries to guide core gas flow past the airfoils. Core gas flow may be defined as gas exiting the compressor passing directly through the combustor and entering the turbine. Vane support rings support and position each vane segment radially inside of the engine diffuser case. In most instances, cooling air bled off of the fan is directed into an annular region between the diffuser case and an outer case, and a percentage of compressor air is directed in the annular region between the outer platforms and the diffuser case, and the annular region radially inside of the inner platforms. The fan air is at a lower temperature than the compressor air, and consequently cools the diffuser case and the compressor air enclosed therein. The compressor air is at a higher pressure and lower temperature than the core gas flow which passes on to the turbine. The higher pressure compressor air prevents the hot core gas flow from escaping the core gas flow path between the platforms. The lower temperature of the compressor flow keeps the annular regions radially inside and outside of the vane segments cool relative to the core gas flow.

Transient thermal periods can cause the stator vane segments to travel axially and radially. During a transient period, for example, the diffuser case and the stator support rings will most often expand and contract at different rates. As a result, the stator vane segments will travel axially and/or radially to accommodate the physical change(s) of the diffuser case and/or support rings.

What is needed, therefore, is a stator vane assembly that accommodates radial and axial movement.

DISCLOSURE OF THE INVENTION

It is, therefore, an object of the present invention to provide a stator vane segment that can accommodate radial and axial movement.

Another object of the present invention is to provide a stator vane segment that adequately seals between the core gas path and the annular regions radially inside and outside each stator vane segment.

According to the present invention, a stator vane segment is provided having an inner platform, an outer platform, an airfoil extending between the inner and outer platforms, and a first sealing flange. The first sealing flange extends out from one of the inner or outer platforms, and includes an arcuate seal surface. The vane segment may pivot about the arcuate seal surface to accommodate movement of the vane segment.

An advantage of the present invention is that the stator vane segment may pivot about an arcuate seal surface if disparities in thermal expansion cause that segment to move axially and or radially in an unsymmetric manner. For example, if a support ring attached to the stator vane segment adjacent the inner platform moved axially, without similar axial movement in the support ring radially outside the vane segment, a moment would be placed on the stator vane segment causing the vane segment to pivot. If the seal surface of the stator vane mounting flange was flat, the seal surface would partially or completely lift off of whatever surface it was in contact with. Under the same circumstances, the present invention stator vane segment is designed to pivot about the arcuate seal surface and avoid lifting partially or completely off of the surface with which it was in contact, thereby maintaining the seal.

These and other objects, features and advantages of the present invention will become apparent in light of the detailed description of the best mode embodiment thereof, as illustrated in the accompanying drawings.

BRIEF DESCRIPTION OF THE DRAWINGS

FIG. 2 is a diagrammatic perspective view of a stator segment.

FIG. 3 is an enlarged view of a stator segment mounting flange, having a first seal surface embodiment.

FIG. 4 is an enlarged view of a stator segment mounting flange, having a second seal surface embodiment.

BEST MODE FOR CARRYING OUT THE INVENTION

Figure 1:
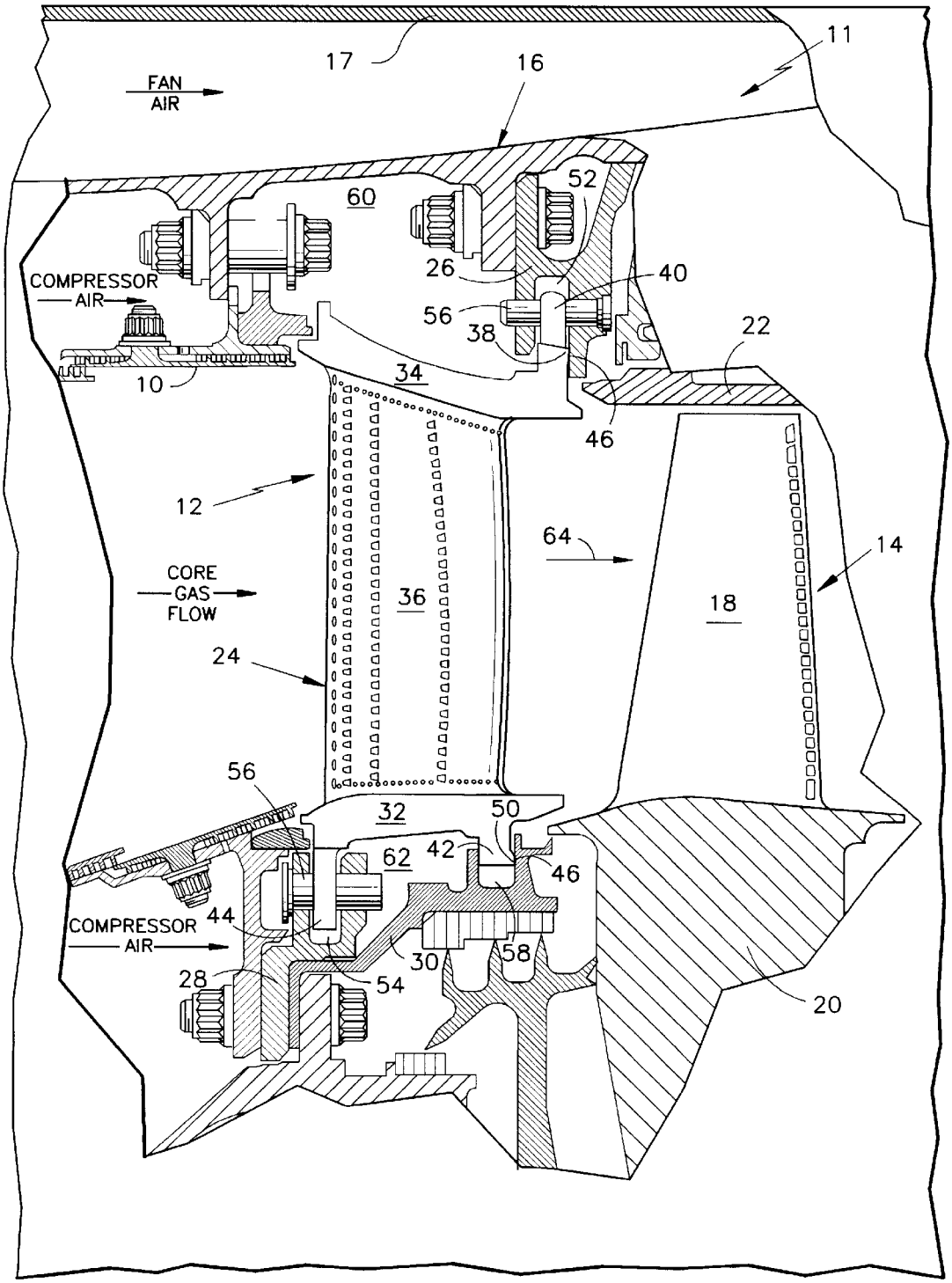
FIG. 1 is a diagrammatic view of a stator assembly and rotor assembly.

Referring to FIG. 1, a gas turbine engine includes a combustor 10 and a turbine 11 having a stator vane assembly 12, a rotor assembly 14, a diffuser case 16, and an outer case 17. The combustor 10 and the rotor assembly 14 are forward and aft of the stator vane assembly 12, respectively. The rotor assembly 14 comprises a plurality of blades 18 attached to a rotatable disk 20, circumferentially spaced around the disk 20. A blade outer air seal 22 is disposed between the blades 18 and the diffuser case 16.

Referring to FIGS. 1–4, the stator vane assembly 12 includes a plurality of vane segments 24, an outer vane support ring 26, and first 28 and second 30 inner vane support rings. Each vane segment 24 includes an inner platform 32, an outer platform 34, and a pair of airfoils 36 extending between the platforms 32,34. The number of airfoils 36 in each segment 24 will vary depending upon the application. A first sealing flange 38 and first mounting flange 40 extend outwardly from the outer platform 34. A second sealing flange 42 and second mounting flange 44 extend outwardly from the inner platform 32. The first 38 and second 42 sealing flanges include arcuate sealing surfaces 46. In an alternative embodiment, the first 38 and second 42 sealing flanges include relief surfaces 48 (see FIG. 4) positioned adjacent the arcuate sealing surfaces 46. The relief surfaces 48 increase the space between the sealing flange 38,42 and the surface 50 being sealed against.

Referring to FIG. 1, the outer vane support ring 26 is fastened to the diffuser case 16 and includes a slot 52 for receiving the first sealing flange 38 and first mounting flange 40 extending out from the outer platform 34. The first inner vane support ring 28 includes a slot 54 for receiving the second mounting flange 44. Pins 56 extend through each slot 52,54 and through each mounting flange 40,44 to secure the vane segment 24 to the first inner 28 or outer 26 vane support ring. The second inner vane support ring 30 includes a slot 58 for receiving the second sealing flange 42. A first annulus

60 is formed between the diffuser case 16, the outer vane support ring 26, and the outer platform 34 of the vane segment 24. A second annulus 62 is formed between the first inner vane support ring 28, the second inner vane support ring 30, and the inner platform 32 of the vane segment 24.

In the operation of the engine, transient thermal periods can cause each stator vane segment 24 to move axially and/or radially. Axial and radial movement typically occurs because of differences in thermal response. The thermal response is prompted by gas temperature changes in the first annulus 60, the second annulus 62, and/or the core gas path 64.

A significant increase in the power setting of the engine, for example, will increase the temperature of the fan air disposed between the diffuser case 16 and the outer case 17, the compressor air in the first and second annuluses 60,62, and the core gas flow within the core gas flow path 64. Thermal expansion radially outside of the vane segments, however, is disproportionate to the thermal expansion radially inside of the vane segments during a transient period because the diffuser case is cooled by fan air. Specifically, the inner vane support rings 28,30 may travel an axial and/or radial distance different than the outer vane support ring 26 and diffuser case 16. Disparity in axial and/or radial motion travel will cause the vane segments 24 to pivot. The present invention arcuate seal surfaces 46 facilitate the pivoting motion and help prevent the seal surface 46 from separating with the contact surface 50. The alternate embodiment having relief surfaces 48 (see FIG. 4) adjacent the arcuate seal surfaces 46 may be used to permit a greater range of pivoting motion, depending upon the application. Alternatively, the relief surfaces 48 may be used adjacent smaller diameter arcuate seal surfaces 46. The smaller diameter arcuate seal surfaces 46 decrease the amount of surface area in contact between the vane support ring 26,28,30 and the flange 38,42, and therefore the bearing stress on the ring 26,28,30 and flange 38,42.

Although this invention has been shown and described with respect to the detailed embodiments thereof, it will be understood by those skilled in the art that various changes in form and detail thereof may be made without departing from the spirit and the scope of the invention.

I claim:

1. A stator vane segment, comprising:

a first platform;

a second platform;

an airfoil, extending between said first and second platforms;

a first sealing flange, extending out from and stationary with said first platform, said first sealing flange having an aft facing first arcuate seal surface;

wherein said vane segment may pivot about said first arcuate seal surface to accommodate movement of said stator vane segment.

2. A stator vane segment according to claim 1, further comprising:

a second sealing flange, extending out from and stationary with said second platform having an aft facing second arcuate seal surface.

3. A stator vane segment according to claim 2, wherein said first and second arcuate surfaces include relief surfaces.

4. A stator vane assembly, comprising:

a plurality of stator vane segments, each segment comprising, a first platform;

a second platform;

an airfoil, extending between said first and second platforms;

a first sealing flange, extending out from and stationary with said first platform, having an aft facing first arcuate seal surface;

a first support ring, having a first slot;

a second support ring, having a second slot;

wherein said first sealing flange is received in said first slot, and said first sealing flange may pivot within said first slot about said first arcuate seal surface.

5. A stator vane assembly according to claim 4, wherein each said stator vane segment further comprises:

a second sealing flange, extending out from and stationary with said second platform, having an aft facing second arcuate seal surface;

wherein said second sealing flange is received in said second slot, and said second sealing flange may pivot within said second slot about said second arcuate seal surface.

6. A stator vane assembly according to claim 5, wherein said first and second arcuate surfaces include relief surfaces.

* * * * *